United States Patent [19]

Stefan

[11] Patent Number: 5,054,472

[45] Date of Patent: Oct. 8, 1991

[54] MASSAGE MACHINE

[76] Inventor: Alexander Stefan, 216 E. Arby Ave., Las Vegas, Nev. 89119

[21] Appl. No.: 436,312

[22] Filed: Nov. 13, 1989

[51] Int. Cl.[5] ..... A61H 7/00

[52] U.S. Cl. ..... 128/58; 128/33; 128/63; 128/70

[58] Field of Search ..... 128/33, 36, 57, 58, 128/52, 70, 56, 59, 60, 63

[56] References Cited

U.S. PATENT DOCUMENTS

| | | | |
|---|---|---|---|
| 1,305,595 | 6/1919 | Gardner | 128/58 |
| 3,687,133 | 8/1972 | Grubelic | 128/58 |
| 4,154,232 | 5/1979 | Fukazawa | 128/58 X |
| 4,751,918 | 6/1988 | Bernard et al. | 128/52 X |

*Primary Examiner*—Edgar S. Burr
*Assistant Examiner*—Moshe I. Cohen
*Attorney, Agent, or Firm*—Charles C. Corbin

[57] ABSTRACT

A massaging machine includes a base support frame, at least one conveyor belt assembly having a pair of horizontally spaced apart drums rotatable on horizontal axes and supporting an endless belt, and a plurality of free-turning belt-spanning rolers engaging the under surface of the upper run of the endless belt to rollingly support it generally in a horizontal plane, and means for driving the endless belt in reciprocal motion. A bed of massage disc is supported by the endless belt and includes a plurality of horizontally spaced parallel axles with their outer ends linked together by pivotable links, and each axle rotatably supporting a pluraltity of free-turning massage discs, and the length of the bed of massage discs being shorter than the endless belt by a predetermined distance. A top, cover sheet of flexible material engages the top of the bed of discs and is held stationarily, and provides an upper surface upon which a person to be massaged may lie, wherein reciprocal motion of the endless belt will turn the massage discs and roll them against the underside of the top sheet causing a massaging effect to be felt by the person lying thereon, as the bed is driven reciprocally.

5 Claims, 2 Drawing Sheets

MASSAGE MACHINE

BACKGROUND

1. Field of the Invention

This invention relates to massaging apparatus, and more particularly to a machine for supporting and massaging the full extent of a person's body.

2. Description of the Prior Art

The prior art is replete with examples of apparatus for massaging a reclining person. Two examples are U.S. Pat. No. 4,154,232 and U.S. Pat. No. 3,687,133, which require relatively complex constructions, and customized, specially made components, rather than commercially available components. Such devices do not lend themselves to economic production and benefits to producer and consumer which flow therefrom. U.S. Pat. No. 3,675,644 shows apparatus for massaging the back region of a person in a sitting position, however it is noted that prior massage machines are unable to massage the back of a person in a sitting position, as well as a person in a fully reclined position.

SUMMARY OF THE INVENTION

In view of the foregoing, it is an object of the present invention to provide a massaging machine that supports and massages the full extent of a fully reclining person as well as being adjustable to a configuration that will support and massage a person in a sitting position.

Another object of the present invention is to provide massaging apparatus that is relatively simple and which can be fabricated from commercially available components.

These, and other objects and advantages will become apparent upon a reading of this summary, and the detailed description and claims which follow.

Accordingly, the present invention provides a massaging machine that includes a support frame, a first conveyor belt assembly mounted to the support frame including a pair of spaced apart drums rotatable on horizontal axes and supporting an endless belt, and a plurality of belt-spanning rollers also supported by the frame for engaging the underside of the upper run of the endless belt to support it generally in a horizontal plane, and at least a second conveyor belt assembly including spaced-apart drums, one of which is supported by the frame adjacent one of the drums of the first conveyor belt assembly, and this at least second assembly also supporting an endless belt with a plurality of belt-spanning rollers supporting its upper run.

This second conveyor belt assembly is pivotable about the axis of its first drum, and is connected to adjusting means for holding it horizontally aligned with the first conveyor belt assembly or to lie at various angles to the first assembly.

The invention includes means for driving the endless belts of the belt assemblies in coordinated reciprocal motion. There is a bed of massage discs, including a plurality of spaced horizontal axles with outer ends linked together by linking members, with each axle rotatably supporting a plurality of free-turning massage discs and the length of the disc bed being shorter than the length of the conveyor belts by a predetermined distance. It will be seen that the changeable orientation of the at least one additional conveyor assembly will permit the device to be varied as required to a sitting configuration from a fully reclining configuration. A flexible sheet platform upon which a person to be massaged may lie, is held stationarily and engaged at its underside by the bed of discs. When the conveyor belts are reciprocally driven they will rotate the plurality of discs comprising the bed, which causes the discs to roll against the underside of the flexible platform, so as to impart through the platform a massaging action that is felt by the person lying thereon.

DETAILED DESCRIPTION OF THE INVENTION

Figure 1:
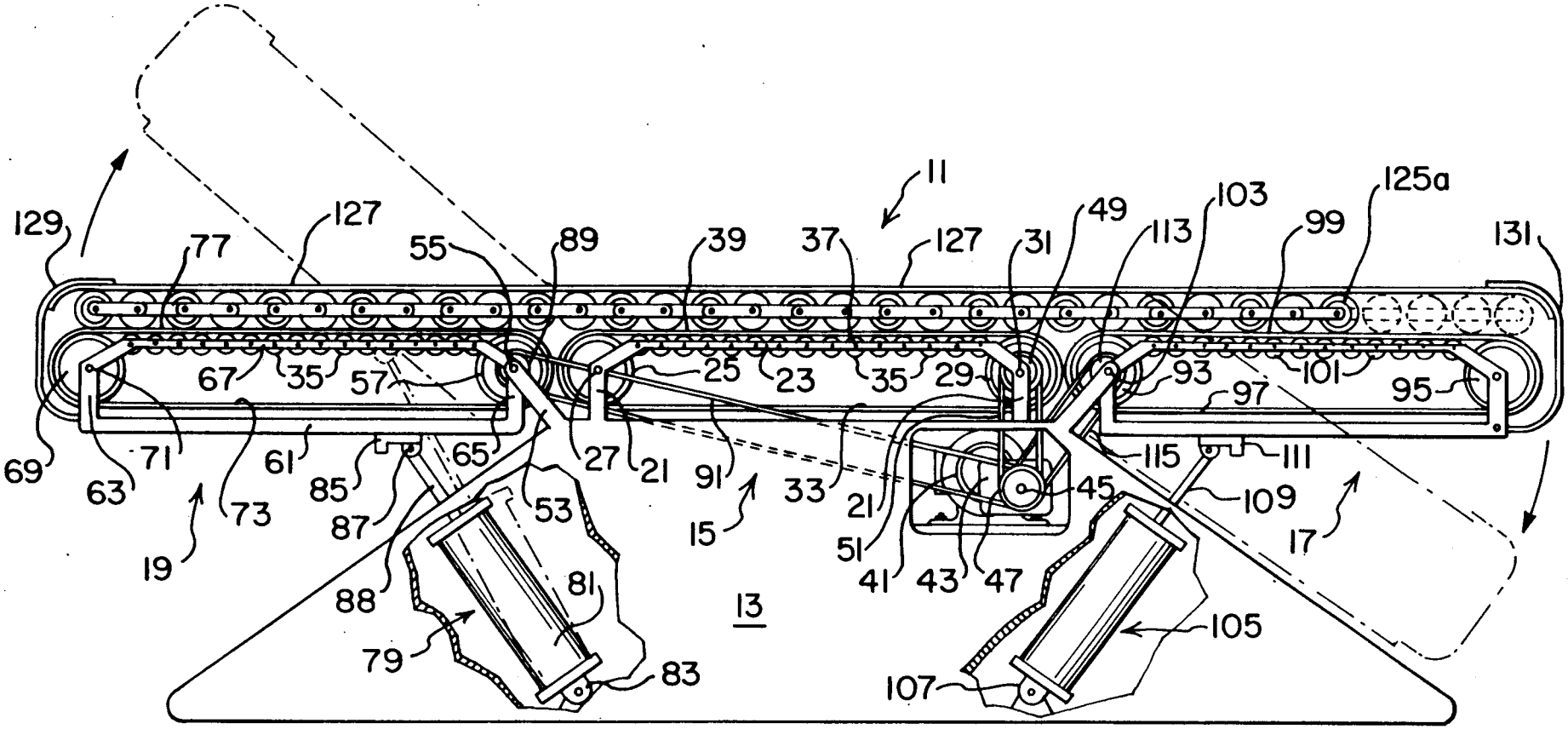
FIG. 1 is a side elevational view of a preferred embodiment of the invention, with parts broken away for the sake of clarity.
Figure 2:
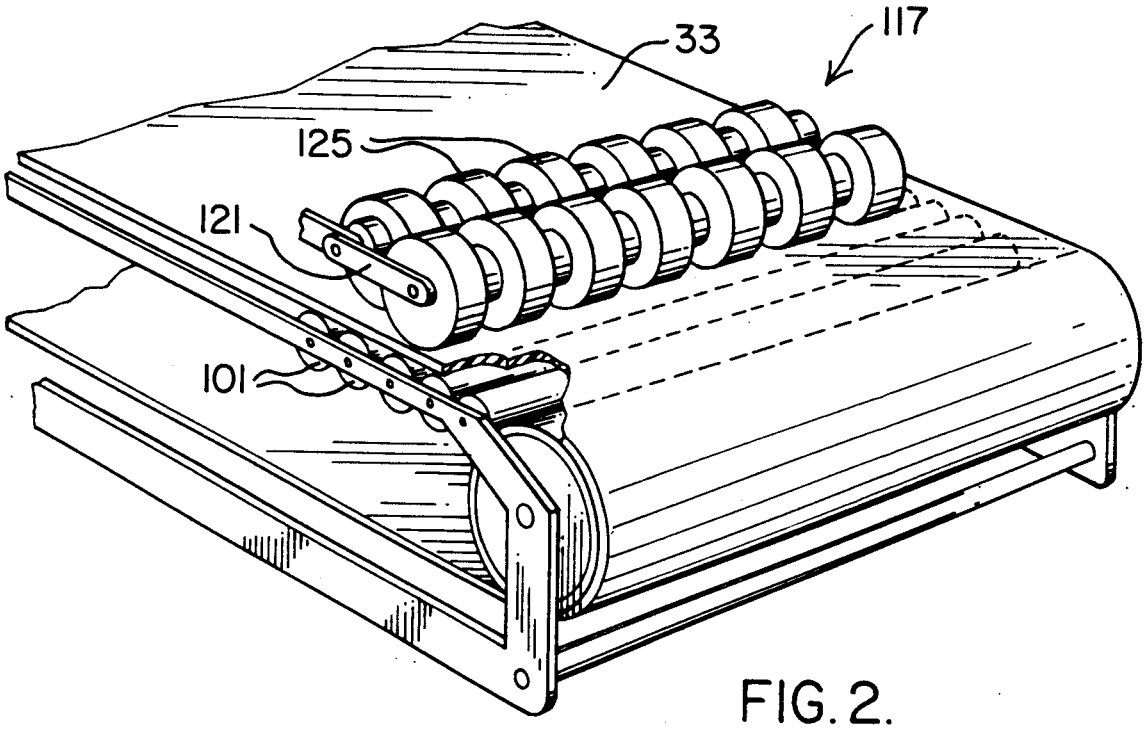
FIG. 2 is a partial view in perspective, also with parts broken away for clarity.

Referring now to the drawings, FIG. 1 shows that a preferred embodiment of a massage machine 11, according to the invention, includes a support frame 13 to which is mounted a central conveyor assembly 15, a forward conveyor assembly 17, and a rear conveyor assembly 19. FIG. 1 shows an elevational view of one side of the preferred embodiment, however it should be appreciated that because of the bilateral symmetry of the structure herein shown, the view of the other side will be essentially a mirror image. The central conveyor assembly 15 is mounted to a support bracket extending from the support frame 13, including the spaced-apart upright supports 21 and the horizontal support 23. A first drum 25 is rotatably mounted with its axle 27 journaled for rotation in upright 21, and a second drum 29 is similarly mounted to the other upright 21 for rotation about the drum axle 31. An endless belt 33, of conventional construction is mounted over drum 25 and drum 29. A plurality of support rollers 35, of dense rubber-like material, span the width of endless belt 33 as illustrated in FIG. 2, and has axle ends 37 that are journaled in the horizontal support 23 for free rotation of rollers 35. Thusly supported, rollers 35 will engage the underside of the top run 39 of belt 33, to hold it in a general horizontal plane and against downward deformation.

An electric motor 41 is secured to the frame 13 and drives a gear box 43 which turns an output shaft 45. Motor 41 is a reversible type AC motor, which can be set to automatically drive the shaft 45 first in one direction for a predetermined number of turns and then in the opposite direction for the same number of turns. A suitable motor for this task is the model 5K921 made by Dayton Electric Motor Corporation. Output shaft 45 mounts three side-by-side drive sprockets 47. A sprocket 49 on the end of drum 29 is connected to one of the drive sprockets 47 by a drive chain 51. Thus the aforedescribed arrangement is designed to drive the endless belt 33 reciprocally.

An arm 53 extends from frame 13 and supports the front end of the conveyor assembly 19 as shown in FIG. 1. In the upper end of arm 53 is journaled the shaft 55 of a conveyor drum 57 which is the same size as the adjacent central conveyor drum 25 and held at the same elevation. The rear conveyor assembly 19 includes a support frame having a lower member 61, uprights 63 and 65, and upper span 67. A rear drum 69 has shaft 71 journaled for rotation in the support upright 63, and an endless belt 73 is mounted over the drums 69 and 57. A plurality of support rollers 75, identical to the belt-spanning rollers 35 of the central conveyor assembly 15, are rotatably mounted to the upper span 67, and engage the underside of the upper run 77 of conveyor belt 73 to hold it generally in a general plane and against inward deformation. Note that rear conveyor assembly 19, by way of its support upright 65, is pivotally mounted about the axle 55, and may be selectively turned about that axle by the hydraulic actuator 79. Actuator 79 has a hydraulic cylinder 81 with its lower end pivotally mounted to the main frame 13 at 83. A support member 85 extends transversely of machine 11, between lower support members 61. A bracket 87 for pivotally mounting the upper end of the hydraulic shaft 88 is affixed midway of the support 85. Finally the rear conveyor assembly 19 includes a sprocket 89 connected to the drum 57, and a drive chain 91 connects one of the drive sprocket 47 with the sprocket 89.

The front conveyor assembly 17 has a construction very similar to that of the aforedescribed rear conveyor assembly 19, with spaced apart drums 93 and 95, and endless belt 97 that has an upper run 99 engaged by support rollers 101. Front conveyor assembly 17 is pivotally mounted about axle 103 of the drum 93, and a hydraulic actuator 105, similar to the actuator 79, has a lower end connected to the main frame 13 at 107 and a drive shaft 109 with an upper end that is pivotally connected to a bracket 111. Finally, a front conveyor 17 includes a sprocket 113 that is connected by a drive chain 115 to the remaining one of the drive sprockets 47.

Figure 3:
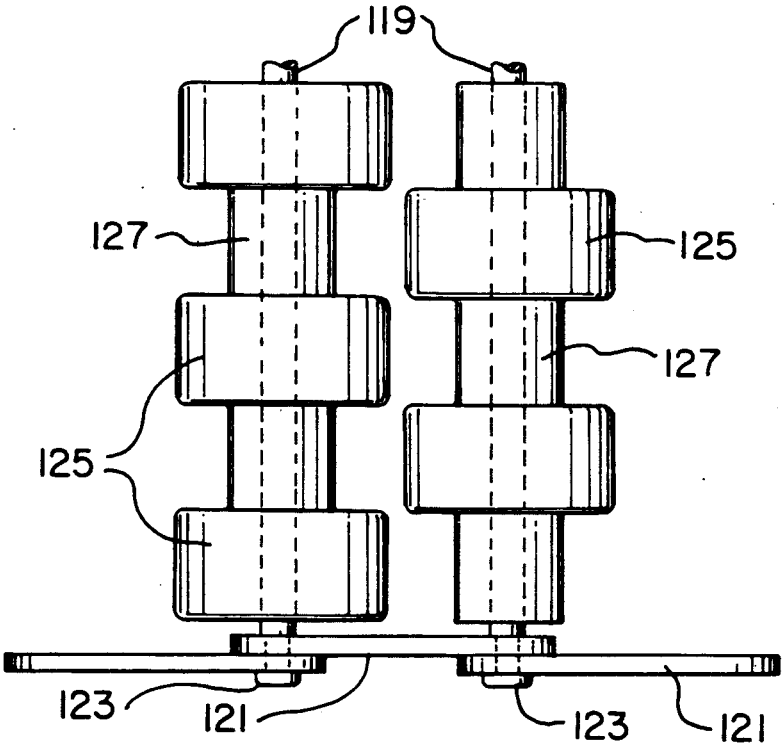
FIG. 3 is a partial, top view of the bed of massage discs.

The invention further includes, as shown in FIG. 1 and FIG. 2, a massage disc bed 117, which includes a plurality of belt-spanning axle-rods 119 having their ends rotatably received in the bores of connecting links 121, with end caps 123 serving to retain the links on the rods 119. FIG. 2 and 3 best illustrate the disc bed 117, and show that each rod 119 has a plurality of hard rubber-like discs 125 and spacers 127 mounted thereover to rotate freely. Note that the discs 125 are spaced evenly and that adjacent rows of discs differ in the order of spacers and discs, such that, as shown in FIG. 3, the discs on any one rod 119 will lie opposite a spacer 127 mounted on an adjoining rod 119. It is preferable that the rubber-like material comprising the discs 125 have, amongst other things, the property of making rolling contact, rather than sliding contact, with the upper surface of the endless belt used in this embodiment. In FIG. 1 the upper runs of the three endless belts 33, 73 and 97 are held in the same general horizontal plane and it is shown that the total length of the disc bed 117 is deliberately shorter than the combined longitudinal extent of the three endless belts. It will be seen that this will allow the reciprocal motion that disc bed 117 will be driven through when the machine 11 is operated.

Finally the invention is seen to include a flexible platform, which can be a sheet of leather-like composition or a rubber-like polymeric material, both materials of which are preferably relatively resilient. Near the rear end of the rear conveyor assembly 19, a frame extension 129 has attached thereto the first end of the flexible platform 127, and a similarly constructed frame extension 131 near the front of the front conveyor assembly 117 holds the other end of the flexible platform 127. Mounted in this manner, the flexible platform 127 will lie with its under side engaging the top of the discs 125 of the disc bed 117 and its upper surface is adapted to receive the person to be massaged. The machine 11 may hold the configuration shown in FIG. 1 which is designed to massage, head to foot, the back region of a fully reclined person. Machine 11 may also assume a chair-like configuration when the hydraulic actuator 79 raises the rear conveyor assembly 19 to the upwardly inclined position indicated by phantom lines, and when the actuator 105 has lowered the front conveyor assembly 17 to a downwardly inclined position. With machine 11 thusly configured a person may sit above the central conveyor with support of the back being provided by the rear conveyor portion and with the lowered end serving to massage the lower legs of the person, in a manner to be described.

Operation of machine 11 will now be described with the disc bed 117 lying in an initial rearward position, as viewed in FIG. 1, with its front row of discs **125*a* spaced about four discs' widths, as indicated in phantom lines, from the front of the machine. With a person lying on the flexible platform 127, the electric motor 41 may be energized. The three drive sprockets 47 will first be driven in a clockwise direction and the associated drive chains will turn the drums 25, 57 and 93 in a clockwise direction, which in turn causes the endless belt upper runs 39, 77, and 99 to move together in a forward direction as viewed in FIG. 1. The under side of the flexible platform 127, assisted by the weight of the person lying thereon, will be urged into frictional engagement with the tops of the massage discs 125, and the lower ends of these discs are urged into frictional engagement with the aforementioned upper runs of the endless belts. This causes the disc 125 to be turned in an counterclockwise direction and to roll along the under surface of the platform 127 in a forward direction, and the entire bed 117 will continue to move forwardly until the lead row of discs 125*a* reaches a position near the forward end of the front conveyor 17. The action of the gear box 43 will then reverse direction of the drive sprockets 47, and thus the direction of the three endless belts. This will have the effect of rotating discs 125 in a clockwise direction and moving the bed 117 toward its initial position shown in FIG. 1. Platform 127** is sufficiently resilient and flexible that the pressure of each disc may be felt by the person lying thereon, thereby to render a massaging effect.

While particular embodiments of the invention have been described herein it is not intended that the invention be limited thereto, since various modifications and changes may readily occur to those skilled in the art without departing from the invention. For example, under the invention a pulley and drive belt system may be used instead of the chain and sprocket drive system of the preferred embodiment. Therefore it is aimed to cover all such changes in its modifications as fall within the true spirit and scope of the invention as defined in the claims which follow.

What is claimed is:

1. A massage machine, comprising:

a) support frame;

b) conveyor belt assembly, mounted to said support frame and including at least a first pair of horizontally spaced apart front and rear drums rotatable on horizontal axes and supporting an endless belt, and a plurality of rollers supported by said frame and spanning the width of said endless belt and engaging the under surface of the upper run of said belt to rollingly support it in a general horizontal plane;

c) means, mounted to said frame, for driving said endless belt in reciprocal motion;

d) bed of massage discs, including a plurality of horizontally spaced parallel axles with outer ends linked together by a plurality of pivotal linking members, each said axle rotatably supporting a plurality of free-turning massage discs, said bed of discs lying in frictional engagement with the top of the upper run of said conveyor belt and supported thereby, and said bed having a length that is shorter, by a predetermined distance, than the length of the upper run of said conveyor belt; and e) top cover sheet of flexible material, providing an upper surface adapted to receive a person to be massaged, the lower surface of which sheet directly engages the tops of said bed of massage discs in rolling contact and said sheet held stationarily relative to said bed of massage discs, and wherein reciprocal movement of said endless belt in conjunction with the engagement of said top sheet with said discs causes said bed to rollingly move along the lower surface of said sheet, first in one direction and then in the opposite direction.

2. Machine as defined in claim 1 wherein said top sheet is sufficiently flexible and thin to allow said bed of discs to be felt therethrough.

3. Machine as defined in claim 2 wherein said top sheet is made of a leather-like material.

4. Machine as defined in claim 1 wherein said conveyor belt assembly includes a central conveyor, a front conveyor and a rear conveyor said front conveyor having a front and rear drum and being pivotable about the rotational axis of its rear drum, and said rear conveyor belt having a front and rear drum and being pivotable about the rotational axis of its front drum, and including means for driving and holding said front and rear conveyors in various angular orientations.

5. Machine as defined in claim 1 wherein said means to drive said endless belt in reciprocal motion comprises a reciprocal-rotary drive means connected by drive belt or drive chain means to one of the drums of said conveyor belt assembly.

* * * * *